US011022373B2

(12) United States Patent
Henderson et al.

(10) Patent No.: US 11,022,373 B2
(45) Date of Patent: Jun. 1, 2021

(54) HEAT EXCHANGERS AND METHODS OF MAKING THE SAME

(71) Applicant: MEGGITT AEROSPACE LIMITED, Christchurch (GB)

(72) Inventors: Steven William James Henderson, Rugby (GB); Jenna Nicole Becker, Leamington Spa (GB)

(73) Assignee: MEGGITT AEROSPACE LIMITED, Coventry (GB)

( * ) Notice: Subject to any disclaimer, the term of this patent is extended or adjusted under 35 U.S.C. 154(b) by 0 days.

(21) Appl. No.: 16/242,432

(22) Filed: Jan. 8, 2019

(65) Prior Publication Data

US 2020/0217591 A1 Jul. 9, 2020

(51) Int. Cl.

| | |
|---|---|
| ***F28D 1/053*** | (2006.01) |
| ***F28F 1/02*** | (2006.01) |
| ***F28F 9/02*** | (2006.01) |
| ***F28D 7/16*** | (2006.01) |

(52) U.S. Cl.

CPC ..... *F28D 1/05383* (2013.01); *F28F 1/022* (2013.01); *F28F 9/02* (2013.01); *F28D 7/16* (2013.01)

(58) Field of Classification Search

CPC .. F28F 7/02; F28F 9/0275; F28F 2255/14–16; F28D 1/0246; F28D 2001/028; F28D 1/05308; F28D 1/05316; F28D 1/05333; F28D 1/05358; F28D 1/05366; F28D 1/05383; F28D 7/0008; F28D 7/0025; F28D 7/0041; F28D 2021/0021

See application file for complete search history.

(56) References Cited

U.S. PATENT DOCUMENTS

| | | | | |
|---|---|---|---|---|
| 596,330 | A * | 12/1897 | Maiche | F28F 7/02 165/164 |
| 4,426,762 | A * | 1/1984 | Schnedecker | C03B 19/01 228/183 |
| 5,251,693 | A * | 10/1993 | Zifferer | F28D 7/0041 165/160 |
| 7,285,153 | B2 * | 10/2007 | Bruun | F23C 13/00 95/43 |
| 2010/0300666 | A1 * | 12/2010 | Hislop | B22F 5/10 165/173 |
| 2014/0174703 | A1 * | 6/2014 | Yoshioka | F28F 9/0278 165/173 |
| 2016/0195336 | A1 * | 7/2016 | Veilleux, Jr. | B22F 3/1055 165/175 |
| 2017/0146305 | A1 * | 5/2017 | Kuczek | F28F 9/0256 |
| 2017/0198976 | A1 * | 7/2017 | Turney | F28D 7/0066 |
| 2017/0198977 | A1 * | 7/2017 | Herring | F28F 9/02 |

(Continued)

*Primary Examiner* — Jianying C Atkisson
*Assistant Examiner* — Jose O Class-Quinones
(74) *Attorney, Agent, or Firm* — Hackler Daghighian Martino & Novak

(57) ABSTRACT

A heat exchanger that comprises a plurality of small channels that are arranged around a cross-sectional perimeter such that the sides of the small channels are touching to create bigger channels running parallel to the small channels. To this end, embodiments of the present invention have a heat exchanger matrix where the structure of the large channels is entirely comprised by the structure of the smaller channels resulting in a more compact, more efficient heat exchanger.

21 Claims, 7 Drawing Sheets

(56) References Cited

U.S. PATENT DOCUMENTS

| | | | | |
|---|---|---|---|---|
| 2017/0198978 | A1* | 7/2017 | Kuczek | F28D 7/0066 |
| 2017/0198979 | A1* | 7/2017 | St. Rock | F28F 21/062 |
| 2017/0205156 | A1* | 7/2017 | Ranjan | F28F 13/08 |
| 2017/0276441 | A1* | 9/2017 | Kuczek | F28D 7/1684 |
| 2018/0238627 | A1* | 8/2018 | Herring | F28D 7/0008 |

* cited by examiner

HEAT EXCHANGERS AND METHODS OF MAKING THE SAME

FIELD

This patent document relates to heat exchangers and methods of making the same. In particular, this patent document relates to new geometric designs for heat exchangers that result in heat exchangers with improved efficiencies.

BACKGROUND

Heat exchangers are used in multiple applications within a vast range of industries. Because of the importance of heat exchangers, there is a constant push to develop heat exchangers that are more efficient, lighter, more compact, more durable and more cost effective. Generally, the industry is always looking for improved heat exchanger designs that optimize one or more parameters of the heat exchanger, depending on the application.

The demands on heat exchangers are becoming particularly more challenging in the area of aircraft engines. Engines have evolved dramatically in the last fifty years. Traditionally, engine nacelles housed a multitude of components including the heat exchangers. With increasing fan diameters, the drag generated by the nacelle becomes too large, necessitating thinner, slim-line nacelles. These thinner nacelles cannot house the components traditionally housed within the nacelle. Instead, these components have to be housed within the core zone. As the core zone already houses ducting, pipework, bleed systems and other components, relocating hardware previously housed within the nacelle can prove to be a challenge due to envelope constraints.

As the fan diameter increases, it has become necessary to reduce the fan speed, relative to the turbine speed, via a reduction gearbox. Heat load from the accessories' gearbox, bearings and generators is typically used to pre-heat the fuel with excess heat being fed into the secondary flow air or air flow external to the nacelle. It is estimated that the additional gearbox will double the heat load introduced into the oil. This additional heat load can only be dissipated into the secondary flow air as the fuel cannot accept any further temperature increases.

As engine manufacturers strive towards more fuel-efficient architectures, systems which are usually driven by compressor discharge pressure, such as ECS, are being powered by electric systems. These systems put extra demand on the electrical generators, again this additional energy results in extra heat load being dissipated into the oil.

As the space around the core of the engine begins to fill with equipment, emphasis is put on reducing the space taken up by individual pieces of equipment. This begins a significant challenge for the heat exchangers where they are required to manage approximately double the heat load but in a smaller volume.

Applicant currently designs and manufactures plate and fin construction heat exchangers for air oil and low-pressure fuel oil applications. An illustration of a plate and fin heat exchanger can be seen in FIG. 1.

Plate and fin heat exchangers are constructed from layers of corrugated fins sandwiched between parting plates. The fins are supported by bars which are located at either end of the fin layer. The heat exchangers transfer heat from the hot fluid of the heat exchanger (depending on the application of the heat exchanger) to the metal surrounding the fluids. The fins act as secondary heat transfer surface area and transfer the heat to the other fluid via conduction. Side plates cap the top and bottom of the plate/fin stack.

The fins and the parting plates are typically 3000 series aluminum. The corrugated surfaces (fins) are produced on a fin forming machine in a variety of patterns e.g. plain, lanced, wavy, perforated or louvred. In most cases the height of the fin and fin density can be tailored to the operating conditions and mechanical constraints of the particular application. Parting plates, or separator sheets as they are also known, are usually from thin gauge material and are clad with a braze alloy on both sides to allow bonding to the fin surfaces. Side plates may be cut from sheet. This would be clad on one side only or, if thicker plates are required for strength, a brazing shim may be added to allow bonding. The bars that close each layer of the core are made from a specific extruded section or may be machined from solid if a particular feature in the core is a requirement.

The heat exchanger core is then assembled in purpose designed fixtures and brazing jigs. The upper platform of the jig is under spring pressure pushing the surfaces together as the core contracts as the clad surfaces disperse to form the joints and fuse together during the brazing process.

The resulting heat exchanger is restricted to rectangular shapes by their construction. The construction also constrains the heat exchanger to being formed in discrete layers. This results in the necessity to use fins to add additional surface area. The fins are classed as secondary heat transfer surface area which has an inherent inefficiency associated with the convective and conductive heat transfer. The layered construction also limits the variation in the flow configurations that can be employed; where typically for plate and fin heat exchangers cross-flow configurations are used. Parallel flow or counter flow can be used but require complex and expensive header constructions.

In recent years, advancements in additive manufacturing have made it a viable option for the production of heat exchangers and heat exchanger components. The use of additive manufacturing for heat exchangers has opened up new possibilities for heat exchanger geometries. In particular, heat exchangers can now be made with geometries that do not have to conform to standard manufacturing principals.

Accordingly, there is a need for new heat exchanger designs that improve on previous designs in any of the heat exchangers criteria but in particular in the areas of efficiency, size and weight.

SUMMARY OF THE EMBODIMENTS

Objects of the present patent document are to provide an improved heat exchanger and improved methods for making heat exchangers. To this end, various embodiments of heat exchangers and methods of making heat exchangers are provided. In preferred embodiments, the heat exchanger comprises: a plurality of smaller first ("A") channels in the heat exchanger matrix running in a first direction wherein each channel in the plurality of channels has a cross-section with an inner shape and an outer shape and wherein the outer shape is the same shape and larger than the inner shape and wherein a distance from the outer shape to the inner shape defines an A channel wall; a plurality of larger second ("B") channels in the heat exchanger matrix running in a second direction parallel and opposite to the first direction, wherein each B channel in the plurality of B channels is formed by a plurality of the smaller A channels arranged around a cross-sectional perimeter of each B channel such that each A channel wall of each A channel in the plurality of A channels touches an A channel wall of at least two other adjacent A channels in the plurality of A channels to form an interior of each B channel in the plurality of B channels.

In different embodiments, the inner shape and outer shape of the A channels may vary between embodiments. For example, the inner shape and outer shape of the A channels may be square, circular, or hexagonal, to name a few. In preferred embodiments, the inner shape and outer shape of the A channels are circles.

Similarly, in various different embodiments, the shape of the larger B channels may also vary. In preferred embodiments, the cross-sectional perimeter of each B channel is four sided. Even more preferably, the cross-sectional perimeter of each B channel is a diamond. In some embodiments, the cross-sectional perimeter of each B channel is a square, triangle, hexagon or circle, to name a few.

As may be appreciated, the embodiments herein are especially efficient because the larger B channels have no additional structure of their own and are comprised entirely from arranging the smaller A channels. Accordingly, in many embodiments, the cross-section of the heat exchanger matrix is comprised exclusively by the cross-section of each A channel in the plurality of A channels.

The heat exchangers discussed herein may use a header to feed the smaller A channels. Accordingly, the heat exchangers may further comprise a header that is coupled to the plurality of A channels but has openings where the gas or liquid feeding the plurality of B channels washes over the outer wall of the header prior to entering the B channels. To this end, embodiments herein may have thermally active headers.

The headers that feed and drain the first channels are separated by the heat exchanger matrix and may be found on opposite sides of the heat exchanger matrix. These headers may be thought of as secondary headers and may each be fed by a primary header. To this end, in some embodiments, the heat exchanger further comprises an input primary header coupled to header on a first side of the heat exchanger matrix and an output primary header coupled to the header on a second side opposite to the first side of the heat exchanger matrix.

The overall form of the heat exchanger is not constrained to cuboid shapes as is typical of current plate and fin heat exchangers. The form of the improved heat exchanger can be curved or conical and/or include conformal regions such as 'scallops' to enable design flexibility when integrating the heat exchanger design into the application environment.

DETAILED DESCRIPTION OF THE DRAWINGS

Figure 1:
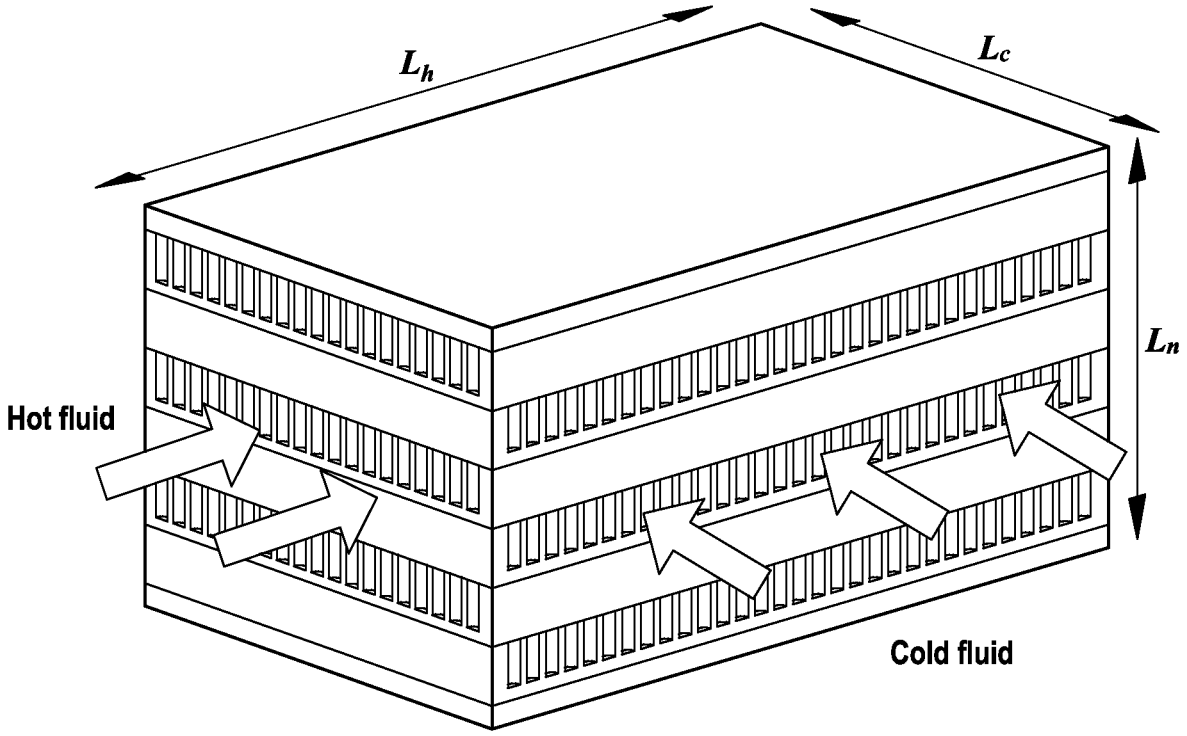
FIG. 1 (Prior Art)
FIG. 1 illustrates an exterior isometric view of a plate and fin heat exchanger according to the prior art.
Figure 2:
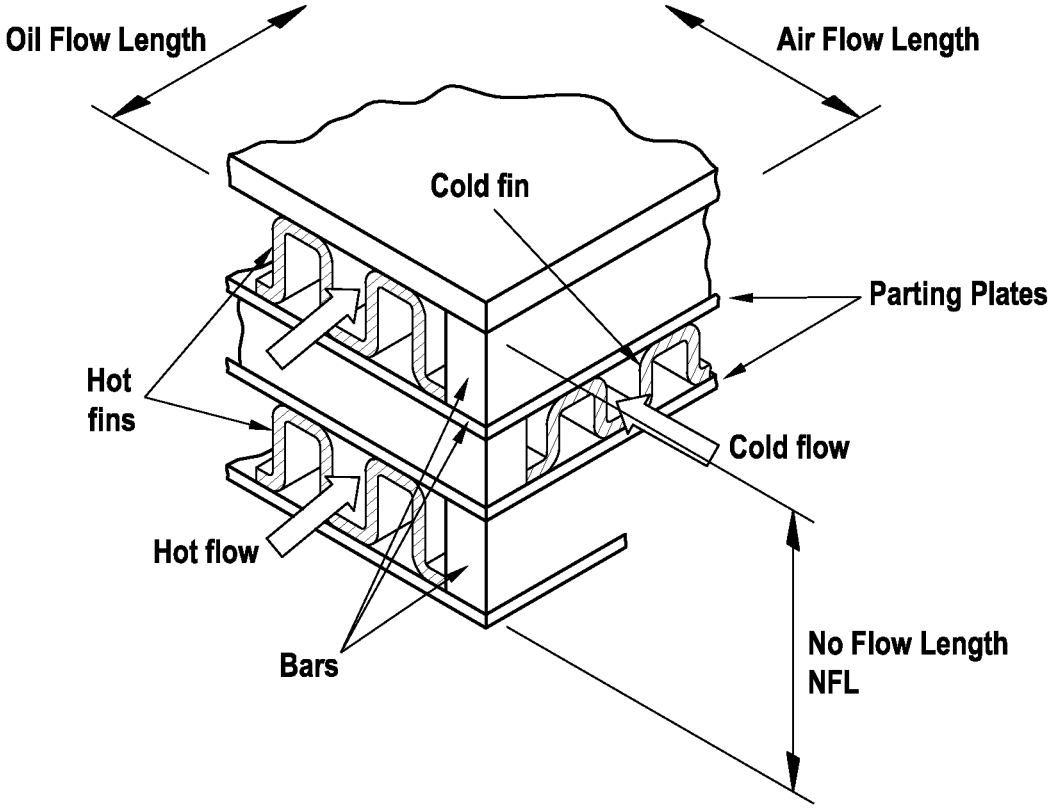
FIG. 2 (Prior Art)
FIG. 2 illustrates a cut-away schematic view of the plate and fin heat exchanger of FIG. 1.
Figure 3A:
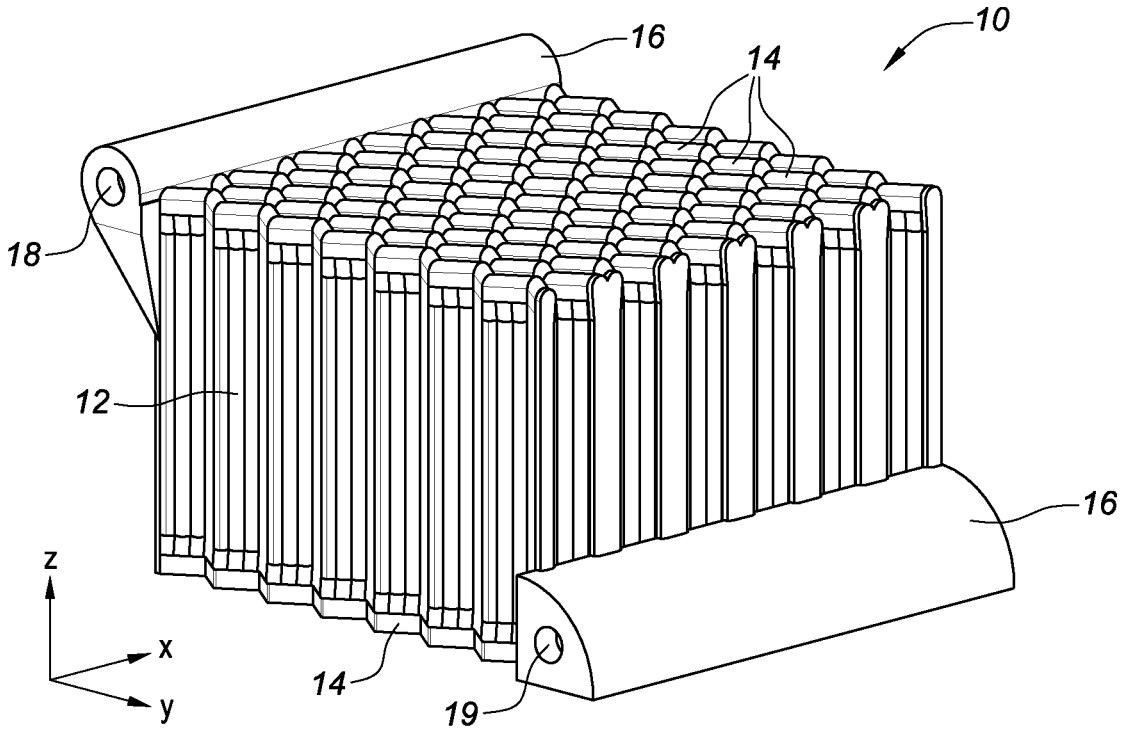
FIG. 3A illustrates an exterior isometric view of a heat exchanger according to the teachings herein.
Figure 3B:
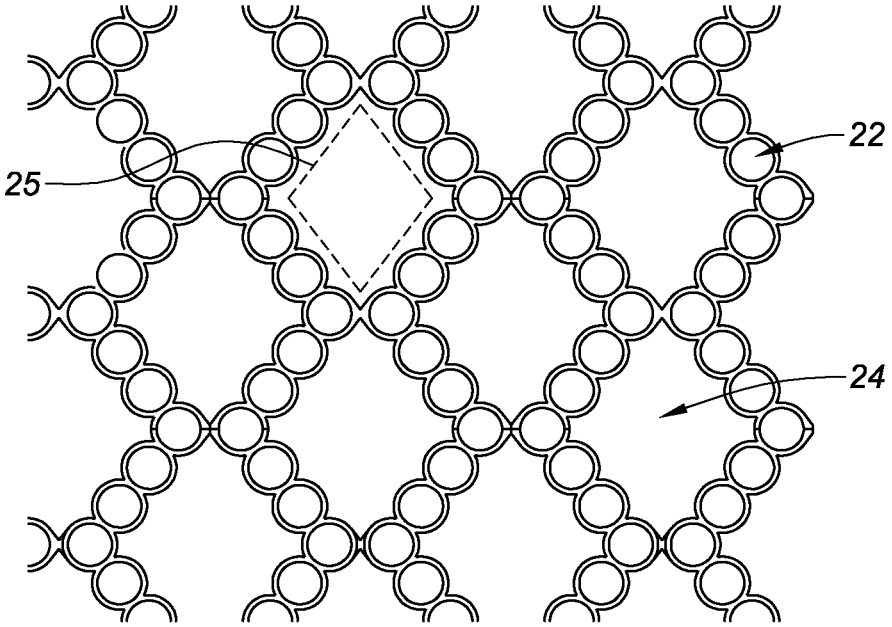

The present patent document describes embodiments of heat exchangers that eliminate or at least ameliorate some of the problems with previous heat exchanger designs. FIG. 3A illustrates an exterior isometric view of a heat exchanger 10 according to the teachings herein. The heat exchanger in FIG. 3 is comprised of three main components: the heat exchanger matrix 12, secondary headers 14 and feeder headers 16. FIG. 3B illustrates a partial cross-section of the heat exchanger matrix 12. As may be seen in FIG. 3B, the heat exchanger matrix 12 is comprised of a plurality of parallel first ("A") channels 22 running in a first direction and a plurality of second ("B") channels 24 running in the parallel and opposite direction. The exterior walls of the smaller A channels all come in contact to form the larger B channels. Each B channel 24 in the plurality of B channels 24 is formed by a plurality of A channels 22 arranged around a cross-sectional perimeter 25 of each B channel 24 such that each A channel wall touches an A channel wall of at least two other adjacent A channels 22 to close off and create the cross-sectional perimeter 25 of each B channel 24.

The novel channel packaging, with the fluid A channels tightly packed around the B channels 24 and the A channel tessellated, mean that the heat transfer surface area within the B channel 24 is always primary surface area, which results in increased heat exchanger performance as there is no compound restriction on secondary surface area efficiency.

The design and techniques taught herein provide for a heat exchanger 10 with a pure counter flow configuration, which is the optimal configuration to maximize the heat transfer and performance. Pure counter flow is incredibly difficult to achieve with Plate and Fin heat exchangers, the current state-of-art for liquid-gas heat exchangers.

Returning to FIG. 3A, in operation, hot fluid enters feeder header, or primary header, 16 through the input port 18. As the hot fluid begins to fill the feeder header 16, the hot fluid moves in the positive x direction along the length of the feeder header 16. The feeder header 16 is in communication with the secondary headers 14 that stretch in the positive y direction across the tops of the A channels 22. The secondary headers 14, follow the pattern created by the plurality of A channels 22 such that the secondary headers 14 cover and are in communication with the A channels 22, while not blocking the B channels 24. Accordingly, the B channels 24 pass completely through the secondary headers 14 on both sides of the heat exchanger.

As the hot fluid fills the secondary headers 14 that stretch across the top of the heat exchanger 10, the hot fluid begins to pass down the A channels 22 in the negative z direction towards the bottom of the heat exchanger 10. Eventually the hot fluid reaches the bottom of the A channels 22 and then passes back into a secondary header 14 at the bottom of the heat exchanger 10. The secondary headers 14 at the bottom of the heat exchanger 10 are similar to the headers on the top of the heat exchanger 10 but just on the bottom instead of on the top. Just like on the top, the secondary headers 14 on the bottom run primarily in the y direction across the bottom of the A channels 22 and are in communication with the A channels 22 and the feeder header 16 on the bottom of the heat exchange 10. The hot fluid then flows through the secondary headers 14 on the bottom of the heat exchanger 10 in the positive y direction towards the bottom feeder header (output header) 16. Eventually the hot fluid enters the bottom feeder header 16 and exits through the exit port 19.

While the "hot fluid" is flowing through the A channels 22, the cold gas or cold fluid enters the B channels on the bottom of the heat exchanger 10 and flows up in the positive Z direction towards the top of the heat exchanger and out the top of the B channels 24 and heat exchanger 10. As the cold air flows up in the positive z direction through the B channels 24 and the hot fluid flows down in the negative z direction through the A channels, the heat is transferred from the hot fluid into the cold air. To this end, the temperature of the hot fluid is reduced as it passes through the heat exchanger.

In the example of operation above, the terms hot fluid and cold gas were used but in either case the substances could be in gas or fluid phase. In addition, while typically the hot fluid would be passed through the A channels, and the cold gas or fluid through the B channels, in some embodiments the cold fluid could be used in the A channels 22 and the hot gas in the B channels 24.

In the embodiments herein, the heat exchanger 10 is designed and manufactured in a pure counter flow configuration, which is the optimal configuration for maximum heat transfer performance. The fluid A channels 22 are tightly grouped around the cross-sectional perimeter or outside wall of the fluid B channels 24, resulting in increased flow area and heat transfer surface area per unit volume. In addition to the packaging benefits offered by this novel configuration, the fluid B channel heat transfer surface area is increased by the outer diameter of the fluid A channels 22, which creates additional shaping of the fluid B channel walls.

Figure 4A:
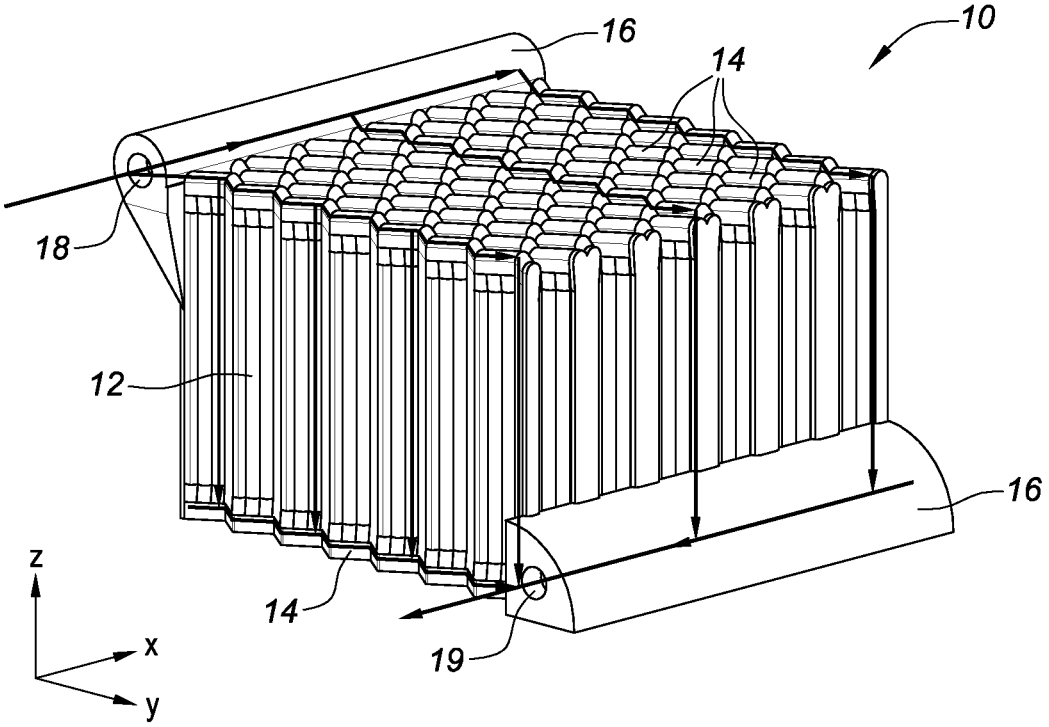
FIG. 4A is an isometric view of the heat exchanger of FIGS. 3A and 3B with a plurality of the flow paths of the hot fluid, or first ("A") fluid, schematically illustrated.

FIG. 4A is an isometric view of the heat exchanger of FIGS. 3A and 3B with a plurality of the flow paths of the hot fluid schematically illustrated. As may be seen in FIG. 4A, the hot fluid path enters the top input header 16 at the import port 18 and then flows across the secondary headers 14 in the positive y direction and down into the A channels. The hot fluid path proceeds through the A channels to the bottom of the heat exchanger 10 and into the secondary headers 14 at the bottom of the device. The hot fluid path continues primarily in the positive y direction into the bottom output header 16 and then out of the heat exchanger through the output port 19.

As discussed, the input and output headers 16 of the heat exchanger 10 are split into the feeder (primary) header 16 and the header 14 (secondary header or thermally active header). The primary headers 16 hold the full mass flow rate of fluid A and feeds the plurality of secondary headers 14. The secondary headers 14 in turn feed each layer of fluid A channels 22. The secondary headers 14 are in the fluid B flow path and are thus, washed by the flow through the B channels 24. To this end, Applicant's design produces thermally active headers 14 in addition to the heat transfer in the heat exchanger matrix 12. Thermally active headers further increase the efficiency of the heat exchanger 10.

Figure 4B:
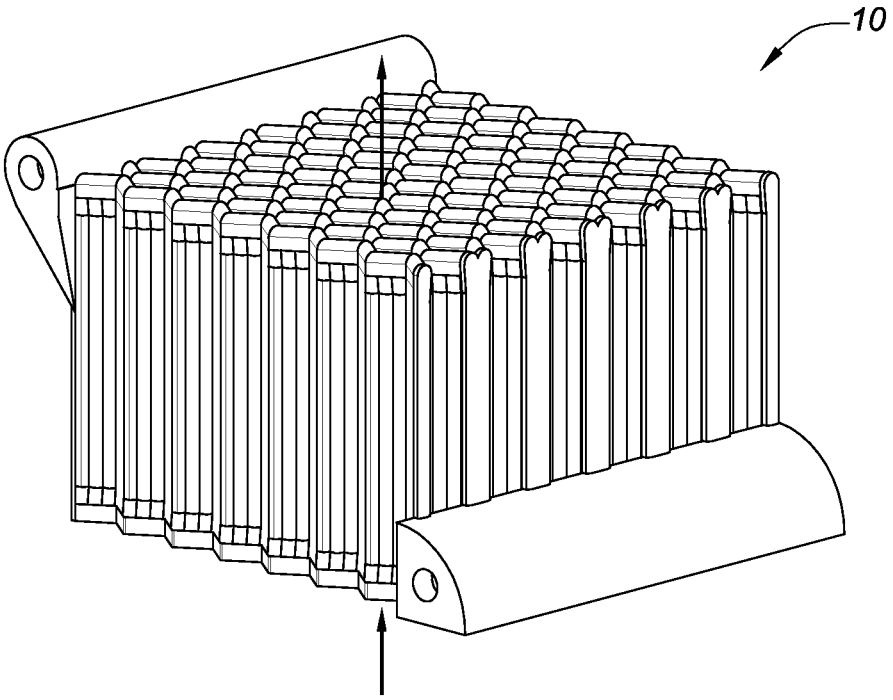
FIG. 4B is an isometric view of the heat exchanger of FIGS. 4A, 3A and 3B with the flow path of the cold fluid, or second ("B") fluid, schematically illustrated.

FIG. 4B is an isometric view of the heat exchanger of FIGS. 4A, 3A and 3B with the flow path of the cold fluid, or B Fluid, schematically illustrated. As explained above, the cold flow enters the B channels through the bottom of the heat exchanger 10 and exits through the top. In doing so, the cold fluid passes through the secondary headers 14 on the bottom of the heat exchanger 10 actively cooling the headers 14. The cold fluid then passes through the heat exchanger matrix 12 and out between the secondary headers 14 on the top of the heat exchanger 10.

Figure 5A:
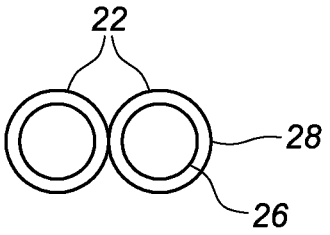
FIG. 5A illustrates a cross-section of two round first ("A") channels touching along their external walls.

FIG. 5A illustrates a cross-section of two circular A channels 22 from within the heat exchanger matrix 12. As may be appreciated, the heat exchanger matrix 12 is always comprised of a plurality of smaller A channels 22. Any number of A channels 22 may be used depending on the size and desired characteristics of the heat exchanger 10.

Each A channel 22 has an inner shape 26 and an outer shape 28. In the embodiment shown in FIG. 5A, the inner shape 26 and the outer shape 28 are the same shape, both circles. As may be appreciated, the outer shape 28 is slightly larger, has a larger diameter, than the inner shape 26. The difference in size defines the thickness of the A channel wall. As manufactured, the inner shape 26 and outer shape 28 are extended down the flow path to form the inner and outer surfaces and the walls of the A channels 22 within the heat exchanger matrix 12.

In preferred embodiments, the inner shape 26 and outer shape 28 are identical other than their size. To this end, it may be said that they are the same shape with the outer shape 28 being larger than the inner shape 26. It is preferable that the inner shape 26 and the outer shape 28 are the same shape. Using the same inner shape 26 and outer shape 28 creates a consistent wall thickness in the A channels 22. However, it is not required that the inner shape 26 and the outer shape 28 be the same, and in some examples, they may be different shapes. For example, in some embodiments, the outer shape 28 may be circular while the inner shape 26 is some other shape such as a square or hexagon etc. Generally, the inner shape 26 and outer shape 28 may be any shape or any combination of shapes.

Figure 5B:
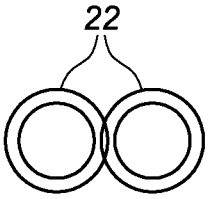
FIG. 5B illustrates a cross-section of two round A channels with partially overlapping walls.
Figure 5C:
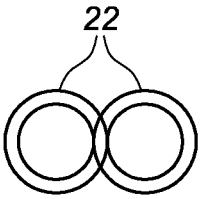
FIG. 5C illustrates a cross-section of two round A channels with completely overlapping walls.

FIGS. 5A through 5C show three different cross-sections of a pair of A channels 22 with different overlaps. In FIG. 5A, the two A channels 22, which in this embodiment happen to be circular, have only their outside surfaces touching. In many embodiments, the A channels 22 are arranged such that only their outside surfaces touch.

In FIG. 5B, the two A channels 22 of FIG. 5A are shown but in this embodiment, the walls of each A channel 22 overlap slightly. Many embodiments may use this very slight overlap of A channel structures or may even overlap more. The more overlap, the more compact the heat exchanger matrix will be. However, some efficiency may be lost as the surface area of the A channels 22 exposed to the B channel 24 is reduced. To this end, the amount of overlap of the A channels 22 may be a design criteria trade-off. Depending on the requirements for the heat exchanger, the A channels 22 may overlap more or less.

FIG. 5C illustrates two A channels 22 where their walls completely overlap. As may be appreciated, in reality, only a single wall is created where the two structures overlap and both sets of walls are shown in the overlap area simply for illustrative reasons.

Figure 6A:
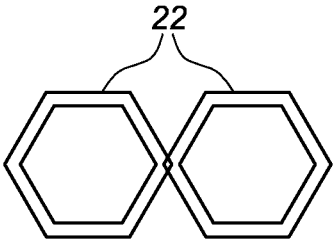
FIG. 6A illustrates a cross-section of two hexagonal A channels just overlapping at their corners.

FIG. 6A illustrates two A channels 22 that have hexagonal cross-sections and overlap only slightly at their corners. As may be appreciated, the cross-section of the A channels 22 may be any shape including circular, hexagonal, pentagonal, square, rectangular, triangular, octagonal or any other shape.

Figure 6B:
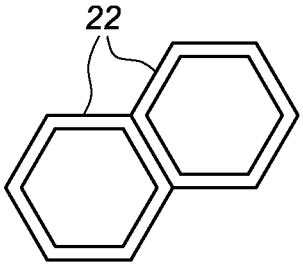
FIG. 6B illustrates a cross-section of two hexagonal A channels coupled along an entire length of a wall.

FIG. 6B illustrates two A channels 22 that have hexagonal cross-sections like the A channels 22 in FIG. 6A except in the embodiment shown in FIG. 6B the A channels 22 touch along a straight side of the hexagonal cross-section rather than at their corners. In different embodiments that use A channels 22 with cross-section that include flat sides, the A channels 22 may come into contact along the flat sides or the corners. As explained above, the larger the contact area between two A channels 22, the sturdier the structure but the less surface area in contact with the B channels 24. Accordingly, how to contact the A channels 22 may be varied as a design choice.

Figure 6C:
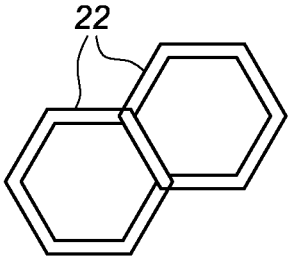
FIG. 6C illustrates a cross-section of two hexagonal A channels that completely overlap along one wall.

FIG. 6C illustrates the A channels 22 of FIG. 6B except in this embodiment the A channels 22 completely overlap along one wall of the hexagonal cross-section. Embodiments, may have A channels 22 with walls that overlap any amount all the way from simply touching on their exterior surfaces to a full wall overlap.

As may be appreciated, the designs suggested herein would be incredibly difficult if not completely impossible to manufacture using any type of convention manufacturing method. To this end, the designs herein are preferably manufactured using additive manufacturing. The additive manufacturing techniques allow for the compact packaging of the heat exchanger flow channels and enables the novel designs and the flexibility in design embodied herein.

Many different types of materials may be used with the additive manufacturing process. To this end, the designs herein may be made from aluminium, (and associated alloys), steel (and associated alloys), titanium (and associated alloys), Inconel (and associated alloys) or any other type of metal that many be used in the additive manufacturing process. Depending on the application, it may also be possible to use a hardened resin or even a ceramic. Basically, any material that may be used in the additive manufacturing process may be used and that includes materials that may be not yet available for the process but available in the future.

Returning to FIG. 3B, it may be seen that the B channels 24 are diamond shaped. However, the A channels 22 may be arranged to create any shape B channel 24 including circular, square, rectangle, pentagon, triangle, hexagon, octagon etc. Varying the shape of the B channels 24 also presents an opportunity for a design trade off. While any shape A channels 22 and B channels 24 may be used, if you want to optimize the surface area of the A channels 22 exposed to B channels 24, it will quickly be realized that A channels 22 with a round cross-section and B channels 24 with a cross-section with flat or straight sides are preferable. To this end, embodiments with A channels 22 that have a round cross-section and B channels 24 with a four-sided cross-section are preferable. Embodiments with A channels 22 with round cross-sections and B channels 24 with square or diamond cross sections are most preferable.

The diamond pattern is preferred for its technical and geometric attributes. The diamond pattern shown in FIG. 3B also allows for compact packaging of the heat exchanger flow channels. The A channels 22 are tightly grouped around the outside wall of the diamond, resulting in potential for an increased fluid A surface heat transfer surface area. The packaging of the A channels 22 around the B channels 24 also mean that the heat transfer surface area within the B channel 24 is always primary surface area, which again is optimal for maximum heat transfer.

In the diamond pattern shown in FIG. 3B, two of the corners of the diamond are comprised by a single A channel 22. In this case, the side corners as the pattern appears in FIG. 3B. In contrast, it takes two A channels 22 to define the other two corners of each diamond. In this embodiment, the top and bottom points of each B channel as illustrated in FIG. 3B. This particular design is easily patternable and maximizes the exposed surface area of the A channels 22 in the diamond pattern.

Figure 7:
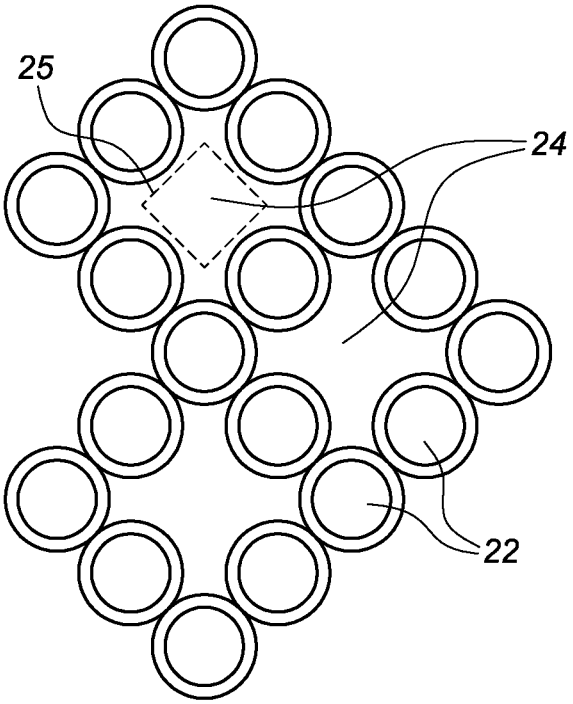
FIG. 7 illustrates a cross-section of a partial heat exchanger matrix with round A channels and diamond shaped B channels.
Figure 8:
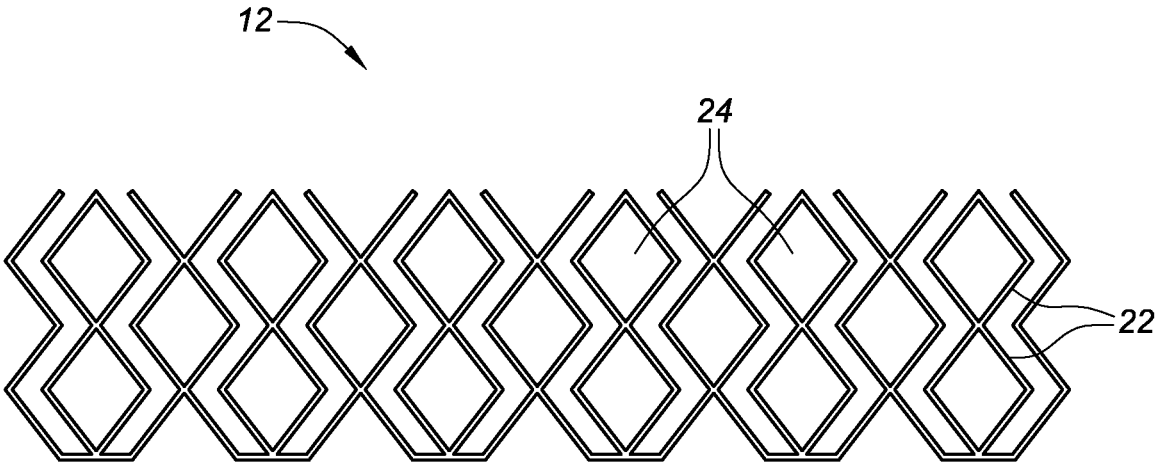
FIG. 8 illustrates a cross-section of a prototype heat exchanger matrix with round A channels and diamond shaped B channels.

FIG. 7 illustrates an embodiment of a heat exchanger matrix with round A channels 22 and diamond B channels 24. Although FIG. 7 has a diamond pattern for its B channels 24, the diamond pattern is different than the diamond pattern shown in FIG. 3B. As may be seen in FIG. 7, each corner of the diamond is defined by a single A channel 22. To this end, each A channel in a corner of the diamond has four contact surfaces with four other A channels 22. In contrast, the diamond pattern in FIG. 3B creates only three contact points on the A channels 22 that form the corners of the diamond or B channel 24.

As may be appreciated, in all the embodiments herein, the A channels 22 and B channels 24 run parallel to each other. This will always be true because the B channels 24 are formed from the outside structure of the A channels 22. To this end, the A channels 22 are running in a first direction and the B channels 24 all run in a second direction parallel and opposite to the first direction.

FIG. 7 illustrates a B channel 24 cross-sectional perimeter 25 with a dashed line within the interior of one of the B channels 24. The cross-sectional perimeter 25 of the B channel 24 does not actually exist and is just used for description purposes. As may be appreciated, the shape of the cross-sectional perimeter 25 of the B channel 24 is a diamond. However, as may also be appreciated, the actual shape of the B channel 24 is much more complex because it extends around and in between each of the exteriors of the round A channels 22. In numerous places herein, the shape of the B channels 24 will be discussed or referred to. When referring to the shape of the B channels 24, reference is being made to the general shape or cross-sectional perimeter shape 25 not the actual interior shape, which will almost always be much more complex.

Returning to FIG. 3B, the diamond shaped B channel heat exchanger matrix of FIG. 3B has been analysed to predict the heat transfer and pressure drop performance and is achieving 'step change' improvements over conventionally manufactured plate and fin heat exchangers. The aluminium selected for trialing the additive manufacturing heat exchanger have been achieving circa ~5 times increase in the yield strength compared to conventional aluminium used in the plate and fin construction. The shape of the B channels 24 and the packaging of the A channels 22 results in a high strength heat exchanger 10.

In various different embodiments, the general concepts of the heat exchangers taught herein may be modified to optimise the performance for a particular application. For example, the embodiments herein may be optimized for their performance and pressure drop through the heat exchanger for bespoke applications. For example, as already discussed, both the A and B channel shapes may be changed.

In the embodiment shown in FIG. 3B, the heat exchanger is shown as a square block and both the A and B channels extend in straight lines along the z axis. However, for applications where the flow path is not a straight line, the geometries of the A and B channels may be changed and may include cross-sections that are "swept path" (e.g. curved, wavy, zigzag, helix etc.) to conform to the desired flow path.

In some embodiments, the secondary headers 14 on the top and/or bottom of the heat exchanger may be profiled or shaped to promote turning of the fluid B flow in inclined or other applications. This allows the secondary headers 14 to perform their function both as headers and also as air foils to direct the B flow. This type of dual-purpose header is only possible in designs where the channel A headers are actively in the path of the channel B flow.

In yet other embodiments, the channel packing and channel geometry or cross section may be variable and may be made to match the fluid B flow profile. In order to enhance the ducted systems performance, variable channel geometries can be used within the heat exchanger to take advantage of non-uniform velocity profiles at the heat exchanger inlet. For example, the size of or density of the fluid B channels 24 may be varied across the profile of the heat exchanger to match the flow pattern. Changing channel density or size to match the flow pattern can help with pressure drop and efficiency. To this end, the size of the B channels 24 may increase from one side of the heat exchanger 10 to another. In yet other embodiments, the size of the B channels 24 may be larger in any particular row or column of the cross section. In yet other embodiments, multiple strategically placed rows or columns of the cross-section have larger B channels 24 to accommodate the flow profile.

Further improvements to the heat exchanger performance can also be made with a variable cold flow length to further maximise performance with non-uniform velocity profiles, the manifestation of this concept would include curved inlet and/or outlet faces.

In some embodiments, the primary headers 16 may be fully encompassed, which could act as flanges for integration with ducting. In a conventional plate & fin heat exchanger, flanges are typically added around the perimeter of the airflow entrance and exit planes. These flanges are used as attachment points to the inlet and outlet air ducts. In the designs proposed herein, the primary headers 16, which are each along one edge of the airflow entrance/exit perimeters, can be extended to encompass the entire perimeter, and the primary headers 16 can mount directly to the inlet/outlet ducting. This would make the primary headers 16 dual-purpose and eliminate the need for mounting flanges.

When manufacturing the embodiments herein, additive manufacturing may be used to create the entire structure as one piece. Manufacturing the entire heat exchanger as one piece reduces the secondary machining process or joining methods, reduces part count and simplifies the supply chain. In yet other embodiments, the primary headers 16 may be made separately and coupled to the heat exchanger matrix 12 and secondary headers 14 after they have been manufactured. In yet other embodiments, the heat exchanger matrix 12 is made with additive manufacturing and both the primary headers 16 and secondary headers 14 are manufactured separately and coupled to the heat exchanger matrix 12 after the three components are manufactured.

The heat exchanger has been designed and manufactured with A channel wall thicknesses ranging from 0.1 mm to 0.5 mm. The wall thickness can be used as a design variable, where the wall thicknesses can be tailored to suit the operating pressures while minimizing the weight and maximising the compactness of the heat exchanger. Wall thickness between 0.01 mm and 10 mm may be used depending on the application and structural and thermal requirements. The thinner the wall thickness the better the thermal performance at the expense of the structural performance. The thicker the walls the better the structural performance at the expense of the thermal performance.

As may be appreciated, the designs herein have no unused structure. The only structure in the entire heat exchanger matrix is the walls of the A channels 22. The B channels 24 have no associated structure because the B channels 24 are made by arranging the A channels 22 around the cross-sectional perimeters of the B channels 24. To this end, embodiments herein may be constructed wherein the cross-section of the heat exchanger matrix 12 is comprised exclusively by the cross-sections of each A channel 22.

In some embodiments, additional secondary heat transfer 'micro features' can be added to the surfaces of the fluid A and/or B channels. As just a few non-limiting examples of micro-features, dimples, protrusions, vortex generators etc., may be added to the surfaces of the A channels 22 and/or B channels 24. Such micro features are used to further increase heat transfer surface area and convective heat transfer.

There is no limit whatsoever on the type of application the heat exchangers described herein may be used for. The applications for the heat exchanger include but are not limited to Air-Oil cooling such as: main oil circuit, oil cooling; power gearbox (fan reduction) oil circuit; integrated drive generator (IDG) oil circuit, oil cooling; variable frequency generator (VFG) oil circuit, oil cooling; permanent magnet generator (PMG) oil circuit, oil cooling. The applications for the heat exchanger may also be used for Air to Air cooling such as: Turbine blade/guide vane cooling; and buffer seal air cooling.

While there is no limit on the type of applications the heat exchangers described herein may be used for, the Applicant designed the heat exchangers herein to be used in aerospace applications and believes they are particularly suited for those types of applications. As one example, the heat exchanger can be integrated within a Ducted Air Oil Mini System. The ducting within the mini systems connects the heat exchanger to the bypass duct air flow. In this configuration the air flow is directed through the heat exchanger prior to being returned to the bypass duct. The air entering the heat exchanger is used as a heat sink for the hotter fluid being passed through the fluid channels within the heat exchanger. In order for the ducting and heat exchanger to be integrated, the primary header can be designed and manufactured so that the header fully encompasses the core of the heat exchanger and becomes the mounting interface between the ducting and the heat exchanger.

Some of the advantages of the heat exchanger designs discussed herein are: 1.) Pure counter flow configuration with novel thermally active header arrangement; 2.) A header that aids the heat transfer performance by being in the fluid B pathway; 3.) 100% primary heat transfer surface area improving heat transfer performance per unit volume; 4.) Compact Fluid A and Fluid B packaging arrangement, which increases the flow area and heat transfer surface area per unit volume; 5.) Structurally robust; 6.) Can be constructed in a one-piece build, reducing the secondary machining process or joining methods; 7.) Secondary surface area can be added to the fluid A and B channels to further enhance the heat transfer performance; 8.) Shaped fluid A headers can be used, which could act as turning features in inclined heat exchanger applications; and 9.) Variable fluid B channel dimensions that match the inlet flow profile can be used to further improve the efficiency of the system.

FIG. 7 illustrates and actual finished prototype of a heat exchanger matrix with round shaped A channels and diamond shaped B channels. In the illustration of FIG. 7, the top face of the secondary header has been removed. The straight walls at the top of the matrix by the secondary header allow for fluid to feed all channels. In the embodiments shown in FIG. 7, the straight walls of this cross-section transition into the circularly bumped cross sections, as shown in FIG. 3B, about a quarter inch down into the heat exchanger matrix. As may be appreciated, the transition from the cross-section shown in FIG. 3B to the straight wall cross-section as shown in FIG. 7 may occur at both the top and bottom of the heat exchanger matrix as the heat exchanger matrix transitions to the secondary headers.

What is claimed is:

1. A heat exchanger comprising:

a plurality of A channels in a heat exchanger matrix running in a first direction wherein each A channel in the plurality of A channels has a cross-section with an inner shape and an outer shape and wherein the outer shape is the same shape and larger than the inner shape and wherein a distance from the outer shape to the inner shape defines an A channel wall;

a plurality of B channels in the heat exchanger matrix running in a second direction parallel and opposite to the first direction, wherein each B channel wall of each B channel in the plurality of B channels is formed by a plurality of A channels arranged along a cross-sectional perimeter of each B channel wall such that each A channel wall of each A channel in the plurality of A channels touches an A channel wall of at least two other adjacent A channels in the plurality of A channels in each B channel wall to form an interior of each B channel in the plurality of B channels.

2. The heat exchanger of claim 1, wherein the inner shape and outer shape are circles.

3. The heat exchanger of claim 2, wherein the cross-sectional perimeter of each B channel is four sided.

4. The heat exchanger of claim 3, wherein the cross-sectional perimeter of each B channel is a diamond.

5. The heat exchanger of claim 3, wherein the cross-sectional perimeter of each B channel is a square.

6. The heat exchanger of claim 1, wherein the cross-sectional perimeter of each B channel is a triangle.

7. The heat exchanger of claim 1, wherein a cross-section of the heat exchanger matrix is comprised exclusively by the cross-section of each A channel in the plurality of A channels.

8. The heat exchanger of claim 1, further comprising a header that is coupled to the plurality of A channels, where each B Channel in the plurality of B channels passes completely through the header via a separate opening in the header.

9. A heat exchanger comprising:

a plurality of A channels in a heat exchanger matrix running in a first direction wherein each A channel in the plurality of A channels has a cross-section with an inner shape and an outer shape and wherein the outer shape is the same as, and larger than, the inner shape and wherein a distance from the outer shape to the inner shape defines an A channel wall;

a plurality of B channels running in a second direction parallel and opposite to the first direction wherein each B channel wall of each B channel in the plurality of B channels is formed by a plurality of A channels arranged along a cross-sectional perimeter of each B channel wall such that each A channel wall of each A channel in the plurality of A channels touches an A channel wall of at least two other adjacent A channels in the plurality of A channels in each B channel wall to form an interior of each B channel in the plurality of B channels; and wherein a cross-section of the heat exchanger matrix is comprised exclusively by the cross-section of each A channel in the plurality of A channels.

10. The heat exchanger of claim 9, wherein the inner shape and outer shape are circles.

11. The heat exchanger of claim 9, wherein the cross-sectional perimeter of each B channel is four sided.

12. The heat exchanger of claim 11, wherein the cross-sectional perimeter of each B channel is a diamond.

13. The heat exchanger of claim 11, wherein the cross-sectional perimeter of each B channel is a square.

14. The heat exchanger of claim 9, further comprising a header that is coupled to the plurality of A channels where each B Channel in the plurality of B channels passes completely through the header via a separate opening in the header.

15. A heat exchanger comprising:

a plurality of A channels in a heat exchanger matrix running in a first direction wherein each A channel in the plurality of A channels has a circular cross-section with a circular inner wall and a circular outer wall and a distance between the circular inner wall and circular outer wall defines an A channel wall;

a plurality of B channels running in a second direction parallel and opposite to the first direction, wherein each B channel wall of each B channel in the plurality of B channels is formed by a plurality of A channels arranged along a cross-sectional perimeter of each B channel wall such that each A channel wall of each A channel in the plurality of A channels touches an A channel wall of at least two other adjacent A channels in the plurality of A channels in each B channel wall to form an interior of each B channel in the plurality of B channels.

16. The heat exchanger of claim 15, wherein the cross-sectional perimeter of each B channel is a four sided.

17. The heat exchanger of claim 16, wherein the cross-sectional perimeter of each B channel is a diamond.

18. The heat exchanger of claim 16, wherein the cross-sectional perimeter of each B channel is a square.

19. The heat exchanger of claim 15, wherein a cross-section of the heat exchanger matrix is comprised exclusively by the cross-section of each A channel in the plurality of A channels.

20. The heat exchanger of claim 15, further comprising a header that is coupled to the plurality of A channels where each B Channel in the plurality of B channels passes completely through the header via a separate opening in the header.

21. The heat exchanger of claim 20, further comprising an input primary header coupled to header on a first side of the heat exchanger matrix and an output primary header coupled to the header on a second side opposite to the first side of the heat exchanger matrix.

* * * * *